US008152485B2

(12) United States Patent
Hsu

(10) Patent No.: US 8,152,485 B2
(45) Date of Patent: Apr. 10, 2012

(54) DC BRUSHLESS MOTOR PUMP

(76) Inventor: Hsia-Yuan Hsu, Daya Township, Taichung County (TW)

( * ) Notice: Subject to any disclaimer, the term of this patent is extended or adjusted under 35 U.S.C. 154(b) by 840 days.

(21) Appl. No.: 12/210,868

(22) Filed: Sep. 15, 2008

(65) Prior Publication Data

US 2009/0010775 A1 Jan. 8, 2009

Related U.S. Application Data

(63) Continuation-in-part of application No. 11/076,622, filed on Mar. 9, 2005, now abandoned.

(30) Foreign Application Priority Data

Jan. 10, 2005 (TW) ..... 94100632 A

(51) Int. Cl.
*F04B 37/06* (2006.01)

(52) U.S. Cl. ..... 417/326; 417/423.7; 310/86; 310/87

(58) Field of Classification Search ..... 417/326, 417/423.1, 423.7; 310/49 R, 86, 87, 216
See application file for complete search history.

(56) References Cited

U.S. PATENT DOCUMENTS 4,482,832 A * 11/1984 Minton ..... 310/216.034
4,664,601 A * 5/1987 Uchida et al. ..... 417/27
5,669,231 A * 9/1997 Itoh et al. ..... 62/210
6,132,186 A * 10/2000 Cooper et al. ..... 417/423.7
6,310,450 B1 * 10/2001 Arrigo ..... 318/400.38

* cited by examiner

*Primary Examiner* — Charles Freay
*Assistant Examiner* — Patrick Hamo
(74) *Attorney, Agent, or Firm* — Ming Chow; Sinorica, LLC

(57) ABSTRACT

A DC brushless motor pump comprises a stator unit consisting of a plurality of silicon steel laminations and a coil, a rotor, an excitation circuit connected to the stator unit, a signal controller supplying power to the excitation circuit, and a magnetic induction module connected to the signal controller to control the pump running. Further, in the pump, a cylinder is provided between the stator unit and the rotor. An orientation component that protrudes in a radial direction is provided on an outer circumferential wall of the cylinder so that the magnetic induction module may be mounted onto the orientation component. Thus, the orientation component is used to fix the magnetic induction module for increasing the accuracy of detection.

6 Claims, 9 Drawing Sheets

DC BRUSHLESS MOTOR PUMP

This invention is a CIP disclosed in U.S. application Ser. No. 11/076,622, issued Mar. 9, 2005, now abandoned.

BACKGROUND OF THE INVENTION

1. Field of the Invention

The present invention relates to a pump, and more particularly to a DC brushless motor pump.

2. Description of the Related Art

Refer to FIGS. 1 and 2 shown as a 3D exploded view and a partially sectional view respectively illustrating a conventional motor pump. The conventional single-phase winding brushless motor pump 1 comprises a motor 10, a body 11, a fan blade member 14, and a front cover 15.

The body 11 includes a housing 112 that defines a chamber 111 and a cover 113 sealing the chamber 111. The housing 112 is provided with a flange 115 arranged at a front sidewall 114, and a cylinder 116 extended into the chamber 111 from the flange 115; thus an opening 117 is formed on the flange 115 of the front sidewall 114 and a pair of L-shaped connectors 118 formed symmetrically about the flange 115.

The motor 10 includes a single-phase winding coil unit 12 and a rotor 13. The rotor 13 includes a rotating shaft 131 and an annular magnetic member 132 surrounding an outer circumference of the rotating shaft 131. The fan blade member 14 is mounted on a front end of the rotating shaft 131, and the rotor 13 is inserted into the cylinder 116 through the opening 117 such that the fan blade member 14 is positioned outside the opening 117. The coil unit 12 is mounted in the chamber 111 surrounding the cylinder 116. Silicon steel laminations 121 of the coil 12 oppose the magnetic member 132 so that the coil 12 is subjected to the magnetic attraction force of the magnetic member 132 to be positioned outside the circumference of cylinder 116.

The front cover 15 includes a basal wall 151, a circumferential wall 152 extending from an outer circumference of the basal wall 151 to thereby define a hollow 150, and a pair of evenly spaced circular extension portions 154 horizontally outwards extending from the circumferential wall 152 and forming two gaps 153. The basal wall 151 is provided with a water intake tube 155 axially corresponding to the fan blade member 14. The circumferential wall 152 is formed with a water outlet tube 156. When the gaps are arranged up and down, the front cover 15 may be aligned to the connector 118 of the body 11 so that, after the front sidewall 114 is kept close to the body 11 and then rotates at an angle, the extension portion 154 may be wedged to the connector 118 and the front cover 15 may be mounted onto the body 11. The water intake tube 155 and the water outlet tube 156 are hollow tubes that respectively extend from outwards the basal wall 151 and the circumferential wall 152.

With reference to FIG. 3 as a circuit block diagram for a conventional motor, the conventional synchronous motor pump further includes an excitation circuit 16. When external power is supplied to the excitation circuit 16, the coil unit 12 is operated to generate a magnetic flux effect to thereby induce the rotor 13 to rotate. Through such operation of the motor 10, water enters through the water intake tube 155, as shown in FIG. 1, and then is centrifugally exhausted via the water exhaust tube 156 by the rotation of the fan blade member 14 fixed to the rotating rotor 13. Hence, pumping of a liquid substance such as water is realized.

Although the conventional pump can achieve its intended purpose, it nevertheless suffers from many drawbacks. Refer to FIG. 4 as a sequence diagram of continuous power supply at a consistent frequency. The conventional pump is supplied with AC power and thus operates with a continuously constant power at 50 Hz or 60 Hz, so the motor 10 is powered with full load from beginning to end. However, the motor 10 is driven with higher power than operation current; for example, the motor 10 operates with a voltage of 115V/60 Hz at a rotation speed of 3600 rpm, and when the voltage is dropped by a transformer to around 100V/60 Hz, the motor still runs constantly at 3600 rpm and the quantity of water is same; thus, around 15% voltage is not helpful and is changed into power loss. Accordingly, at the beginning of operation with full load, the efficiency cannot be enhanced in operation and even more power is much consumed.

Consequently, because of the technical defects of described above, the applicant keeps on carving unflaggingly through wholehearted experience and research to develop the present invention, which can effectively improve the defects described above.

SUMMARY OF THE INVENTION

Therefore, an object of the present invention is to provide a DC brushless motor pump. After going with an excitation circuit and magnetic induction module, an AC single-phase winding synchronous motor is changed into a DC brushless motor.

Another object of the present invention is to provide the DC brushless motor pump designed for power saving and smooth operation and effluent.

A further object of the present invention is to provide the DC brushless motor pump that enhances the effect of orientation of the magnetic induction module for achievement of stable operation.

The DC brushless motor pump according to this invention comprises a body, a cylinder extending inwards from a sidewall of the body, a stator provided in the body and arranged outside the circumference of cylinder, a magnetic rotor provided in the cylinder, a blade member being formed at a front end of the rotor and passing through the cylinder, and a front cover that covers an open mouth of the cylinder and defines a hollow. A water intake tube corresponding to the blade member, and a water outlet tube is provided between the front cover and the body. The pump is further provided with a control unit comprising an excitation circuit, a signal controller, and a magnetic induction module. The excitation circuit is connected to an input terminal of the stator to excite the stator, thereby the rotor being driven to rotate. The signal controller supplies power to the excitation circuit and may continuously generates pulse signals of different frequencies, and when supplying power, the controller supplies the pulse signals of low frequencies through high frequencies to the excitation circuit to excite the stator and thus drive the rotor to rotate increasingly fast, in which the magnetic induction module is connected to the signal controller. Further, the stator comprises multiple U-shaped silicon steel laminations and coils continuously wrapping around the Silicon steel laminations. Besides, an orientation component that protrudes in a radial direction is provided on an outer circumferential wall of the cylinder and meanwhile orients the magnetic induction module.

In this invention, mainly going with an excitation circuit and magnetic induction module, an AC single-phase winding synchronous motor is changed into a DC brushless motor. Further, the orientation component is used to fix the magnetic induction module for increasing the stability of the motor running.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
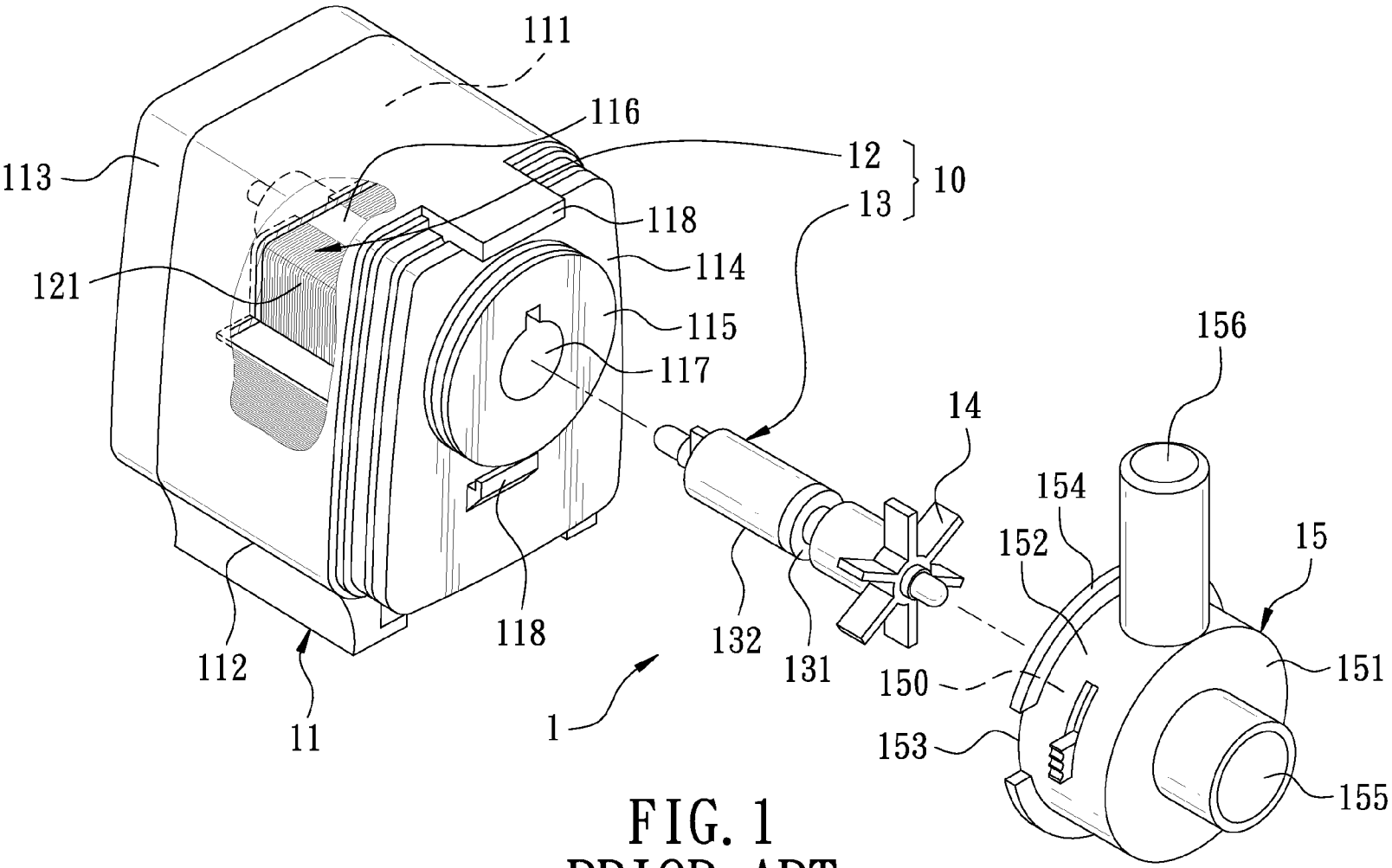
FIG. 1 PRIOR ART
FIG. 1 is a 3D exploded view of a conventional motor pump.
Figure 2:
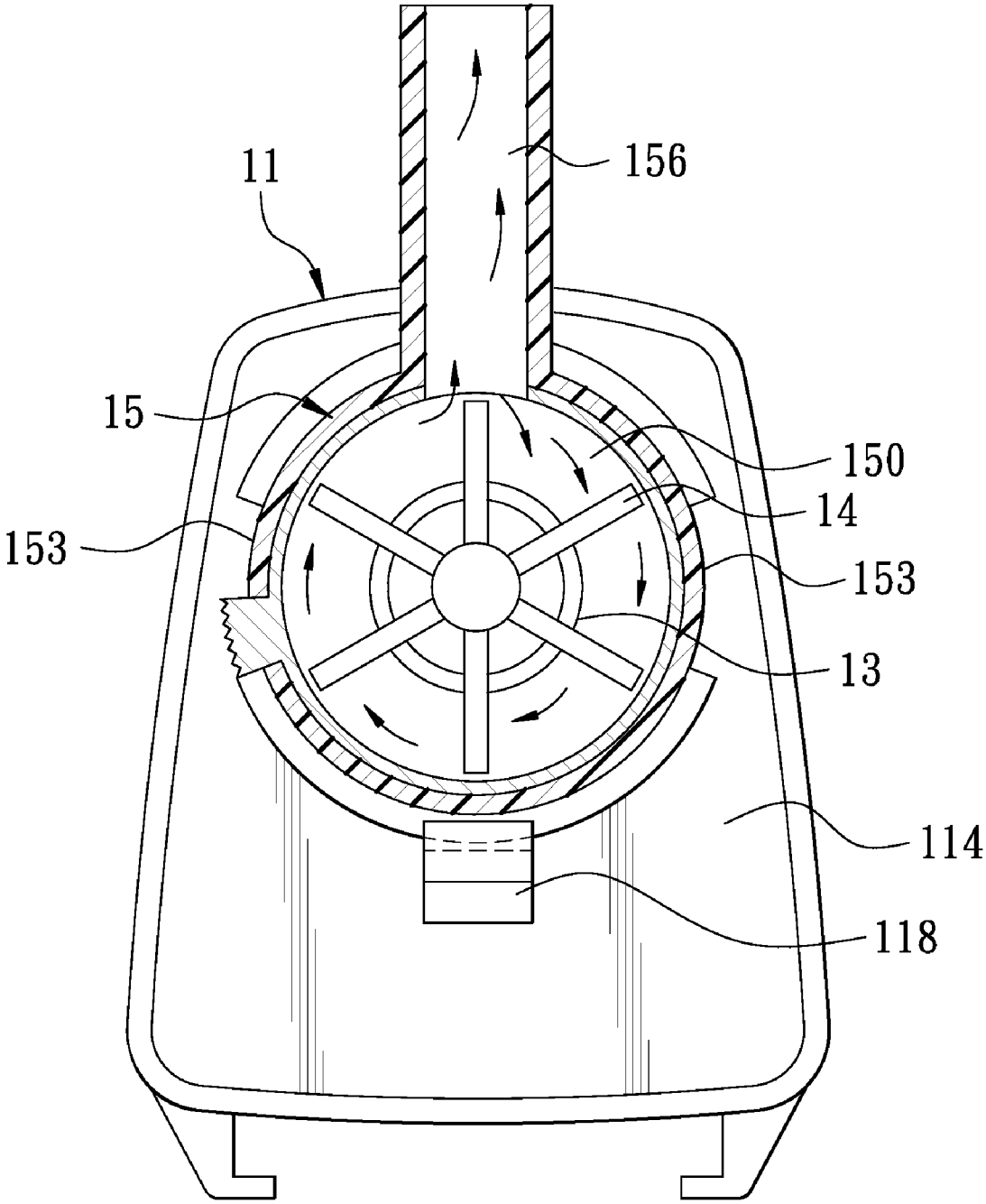
FIG. 2 PRIOR ART
FIG. 2 is a partially sectional view of the conventional motor pump.
Figure 3:
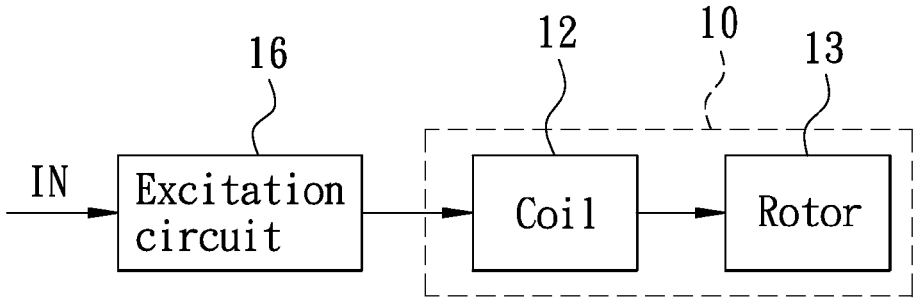
FIG. 3 PRIOR ART
FIG. 3 is a circuit block diagram of the conventional motor.
Figure 4:
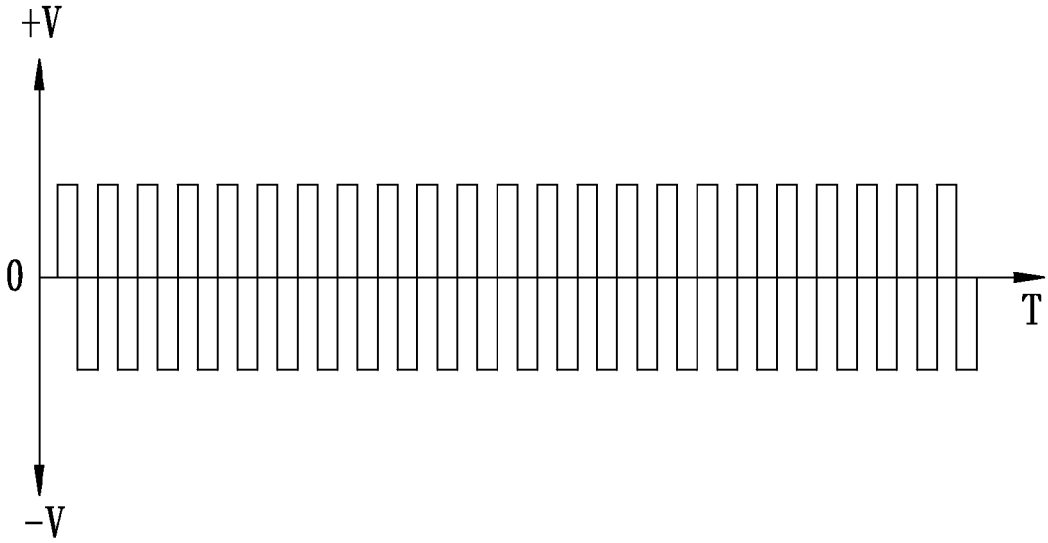
FIG. 4 PRIOR ART
FIG. 4 is a sequence diagram of continuous power supply at a consistent frequency.
Figure 5:
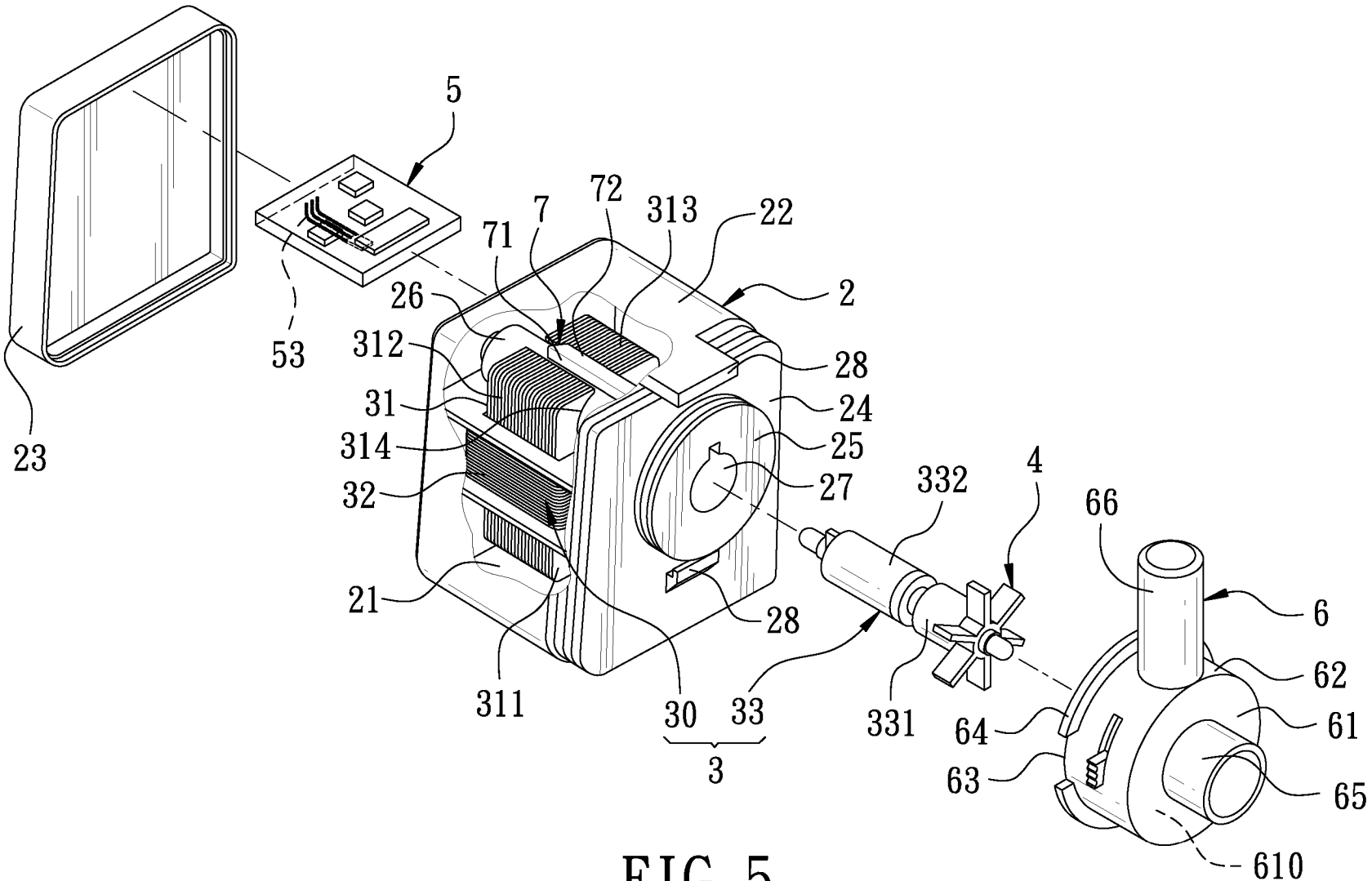
FIG. 5 is a 3D exploded view of this invention.

With reference to FIG. 5 as a 3D exploded view of this invention, a DC brushless motor pump according to this invention comprises a body 2, a motor 3, a blade member 4, a control unit 5, and a front cover 6, and an orientation component 7.

The body 2 is provided with a housing 22 that defines a chamber 21, and a cover 23 sealing the housing 22. The housing 22 is provided with a flange 24 arranged at a front sidewall 25, and a cylinder 25 extended into the chamber 21 from the flange 26; thus an opening 27 is formed on the flange 24 of the front sidewall 25 and a pair of L-shaped connectors 28 formed symmetrically about the flange 25.

Figure 8:
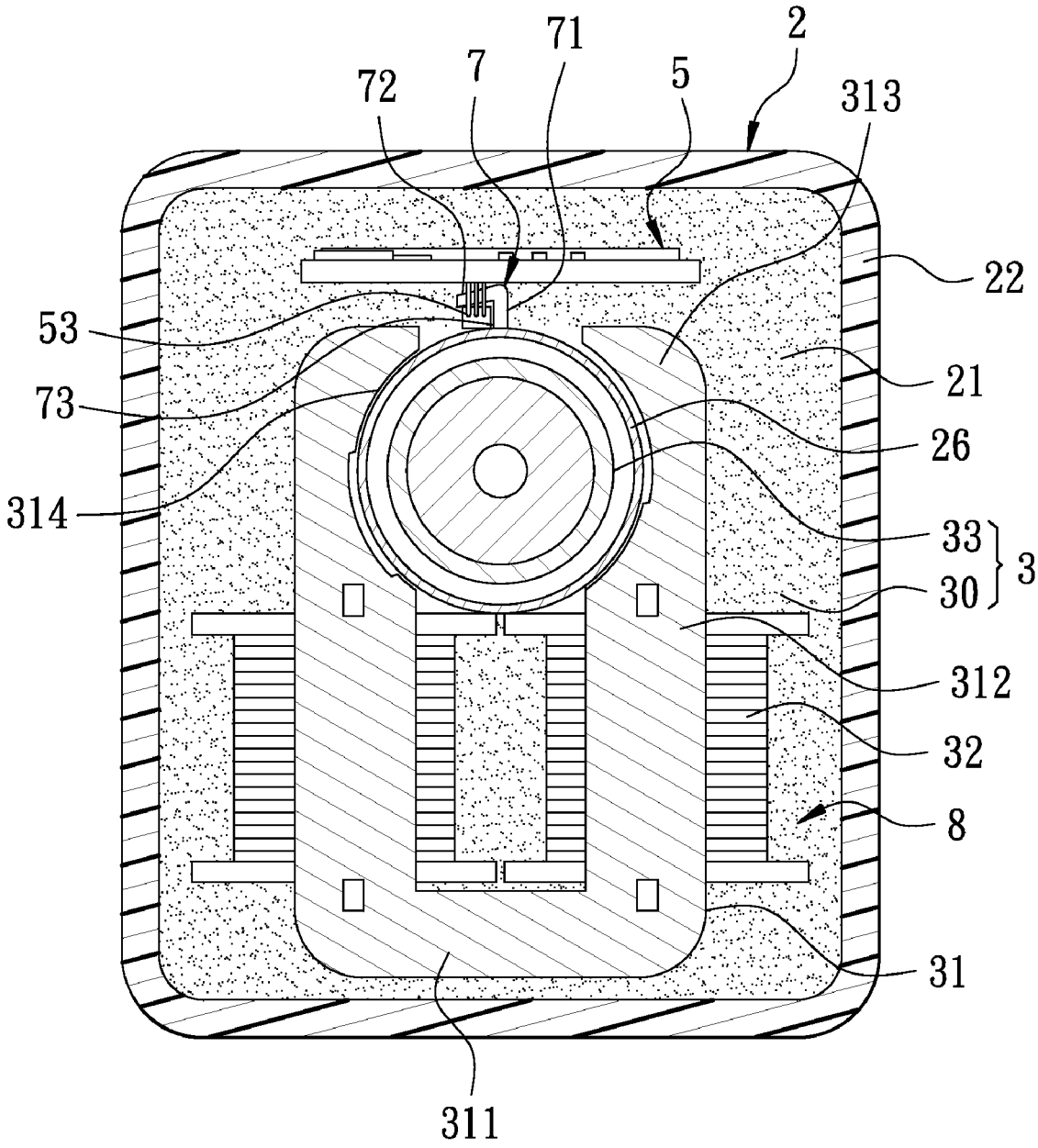
FIG. 8 is a partially sectional view of this invention, illustrating an orientation component clamping the control unit.

The motor 3 includes a stator unit 30 and a rotor 33. The coil unit 30 is mounted in the chamber 21 and includes a plurality of silicon steel laminations 31 and a plurality of coils 32 continuously surrounding the steel laminations 31. With reference to FIG. 8 as a partially sectional view of this invention, the silicon steel laminations 31 substantially has a U shape, below which a base 311 is formed. A pair of arms 312 are provided extending upwardly from two sides of the base 311. A pair of free ends 313 are respectively formed at top ends of the arms 312 and thus fully lies at two sides of the cylinder 26. A pair of arc-shaped grooves 314 are formed corresponding to the top ends of the arms 312, thereby magnetic poles being formed. The cylinder 26 is provided between the arc-shaped grooves 314. Further, the coils 32 wrap around the arms 312 of the silicon steel laminations. The rotor 33 includes a rotating shaft 331 and an annular magnetic member 332 surrounding an outer circumference of the rotating shaft 331. The blade member 4 is axially provided at a front end of the rotating shaft 331. The rotor 33 is inserted into the cylinder 26 through the opening 27 such that the fan blade member 4 is positioned outside the opening 27. The silicon steel laminations 31 oppose the magnetic member 332 so that the stator unit 30 is subjected to the magnetic attraction force of the magnetic member 332 to be positioned outside the circumference of cylinder 26.

The front cover 6 includes a basal wall 61, a circumferential wall 62 vertically extending outwards to thereby define a circumferential wall 62 of a chamber 610, and a pair of evenly spaced circular extension portions 64 horizontally outwards extending from the circumferential wall 62 and forming two gaps 63. The basal wall 61 is provided with a water intake tube 65 axially corresponding to the fan blade member 4. The circumferential wall 62 is formed with a water outlet tube 66. When the gaps 63 are arranged up and down, the front cover 6 may be aligned to the connector 28 of the body 2 so that, after the front sidewall 24 is kept close to the body 2 and then rotates at an angle, the extension portion 64 may be wedged to the connector 28 and the front cover 6 may be mounted onto the body 2. The water intake tube 65 and the water outlet tube 66 are hollow tubes that respectively extend from outwards the basal wall 61 and the circumferential wall 62.

Figure 6:
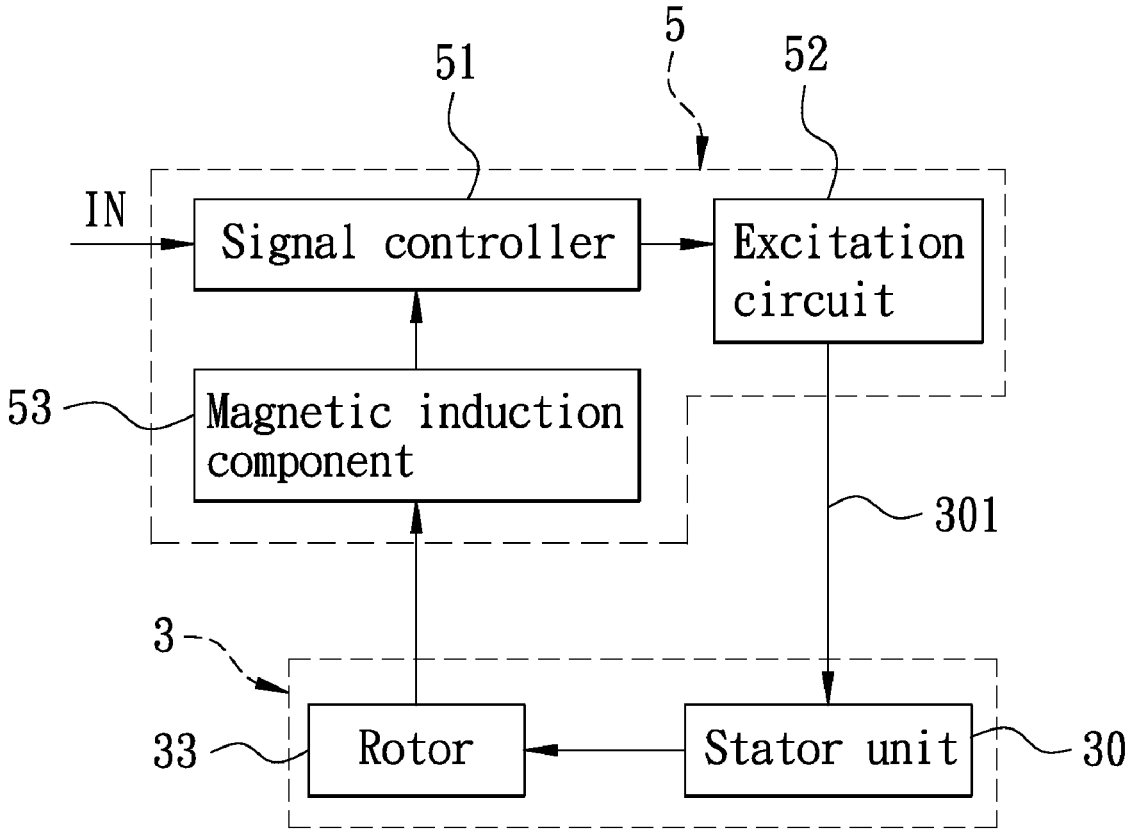
FIG. 6 is a circuit block diagram of a control unit according to this invention.

With reference to FIG. 6 as a circuit block diagram of a control unit according to this invention, the control unit 5 is provided in the body 2 and arranged above the motor 3, in which the unit 5 is a circuit control board, comprising a signal controller 51, an excitation circuit 52, and a magnetic induction module 53. The excitation circuit 52 is connected to an input terminal 301 of the stator 30 to excite the stator unit 30, thereby the rotor 33 being driven to rotate. The signal controller 51 supplies power to the excitation circuit 52 and may continuously generates the pulse signals of different frequencies, and in a period of power supply, the pulse signals of increasing frequencies is supplied to the excitation circuit 52 to excite the stator unit 30, thereby the rotor 33 being driven to rotate more slowly. Then, pulse signals of stable and higher frequencies are supplied to the excitation circuit 52 to excite the stator unit 30, thereby the rotor 33 being driven to rotate faster. Next, the magnetic induction module 53 is connected to the signal controller 51 and provided at a side outside the circumference of cylinder 26, and N and S poles of the rotor 33 are sensed to generate a correct signal feedback to the signal controller 51. Meanwhile, signal supply is uninterruptible to excite the driven rotor 33 to run more smoothly. In a preferred embodiment of this invention, the magnetic induction module 53 is a Hall element.

Figure 7:
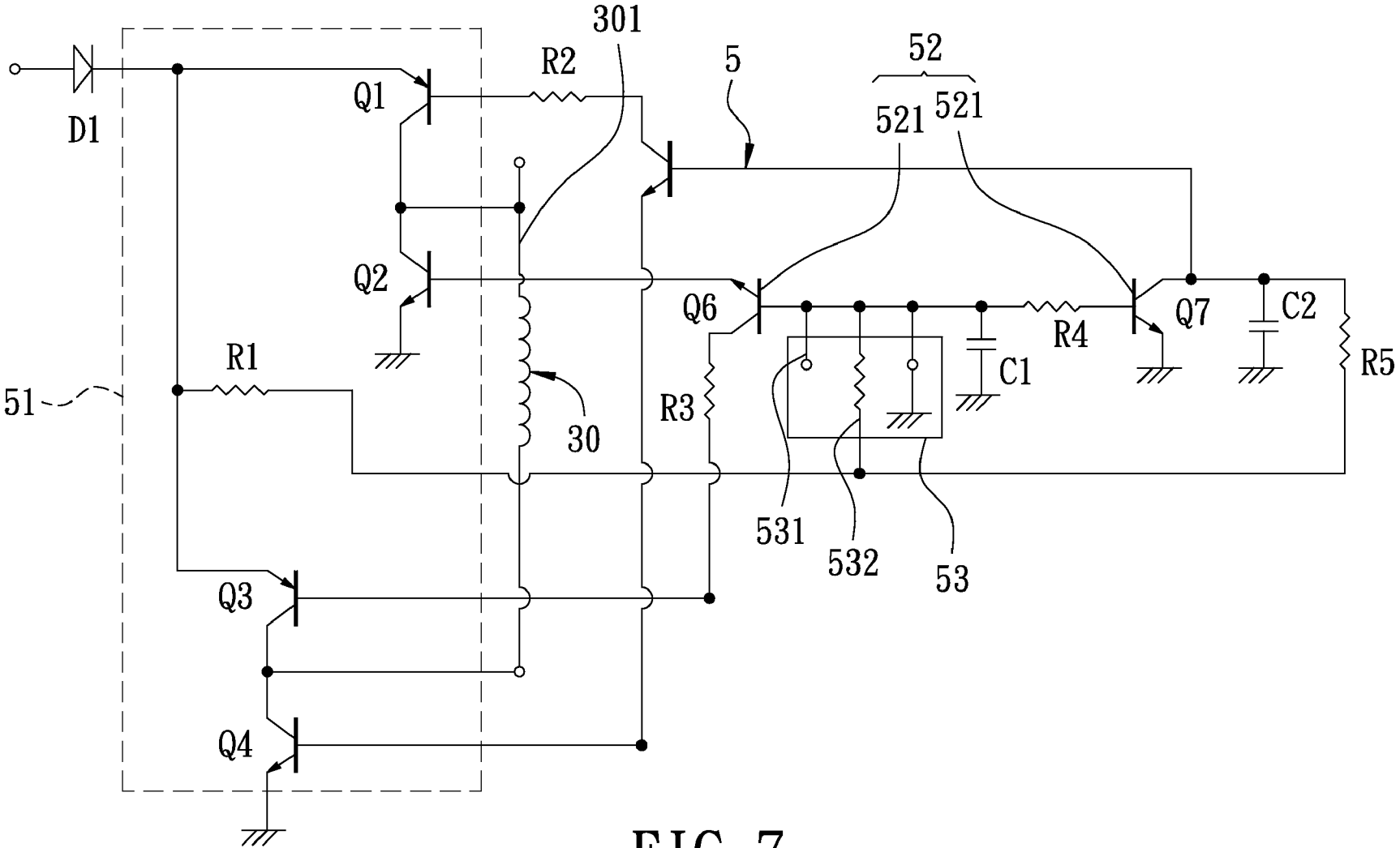
FIG. 7 is a circuit diagram of the control unit according to this invention.

With reference to FIG. 7 as a circuit diagram of a control unit according to this invention, the excitation unit 52 includes a number of power transistors 521 (Q6 and Q7) and is connected to the input terminal 301 of the stator unit 30. When the excitation unit 52 receives DC power, it performs an excitation function by causing the stator unit 30 to undergo quick conversion between positive and negative poles to thereby drive the rotor 33 by the rapid conversion between N and S poles of the stator unit 30. Hence, rapid driving is achieved. Further, the magnetic induction module 53 comprises a detection pin 531 and a signal control pin 532 connected to the signal controller 51. The detection pin 531 is used to detect the N and S poles of the rotor 33 and make the magnetic induction module 53 generate a signal, and the signal control pin 532 feedbacks the signal to the signal controller 51, thereby the rotor 33 is driven to run more smoothly.

Figure 9:
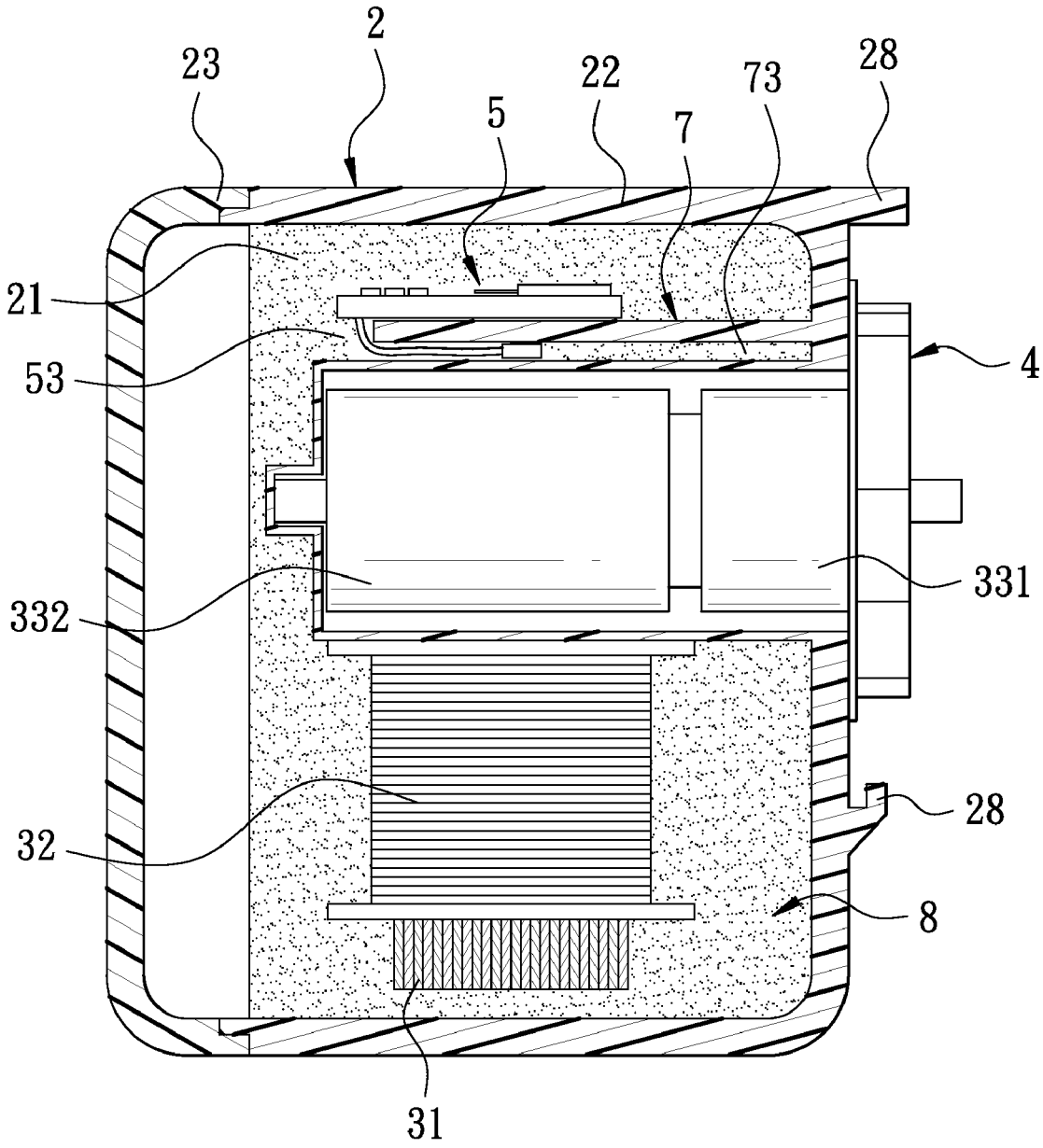
FIG. 9 is the other partially sectional view of this invention, illustrating the orientation component clamping the control unit.

Refer to FIGS. 8 and 9 as partially sectional views of this invention, illustrating the orientation component clamping the control unit. The orientation component 7 projects on the outer circumferential wall of the cylinder 26 and is in the form of L upside down, where a first plate 71 is provided lengthways extending upwards from the middle of the outer circumferential wall of cylinder 26; then, a second plate 72 is provided transversally extending leftwards from the top end of the first plate 71, so a container portion 73 is defined between the outer circumferential walls of the first plate 71, second plate 72, and cylinder 26 of the orientation component 7, the pin of magnetic induction module 53, after being properly bent in a horizontal direction, exactly makes the magnetic induction module 53 transversally lie in the container portion 73, the magnetic induction module 53 is clamped, and the position of magnetic induction module 53 does not vary with wobble or vibration, thereby the accuracy of detection of the magnetic induction module 53 being increased. The magnetic induction module 53 exactly lies between the two poles of the silicon steel lamination 31 and slightly leans to one of the poles. In the embodiment, the magnetic induction module 53 leans to the left-side pole so that the magnetic induction module 53 may exactly sense the variation of the poles of the rotor 33. In this invention, a filling glue 8 may be filled in the chamber 21 of the housing 22, in which it is made from an insulation material to fill all the gaps in the chamber 21. Thus, the orientation component 7 is enhanced to fix the control unit 5 and its magnetic induction module 53. In the preferred embodiment of this invention, the filling glue 8 is a foam resin.

Figure 10:
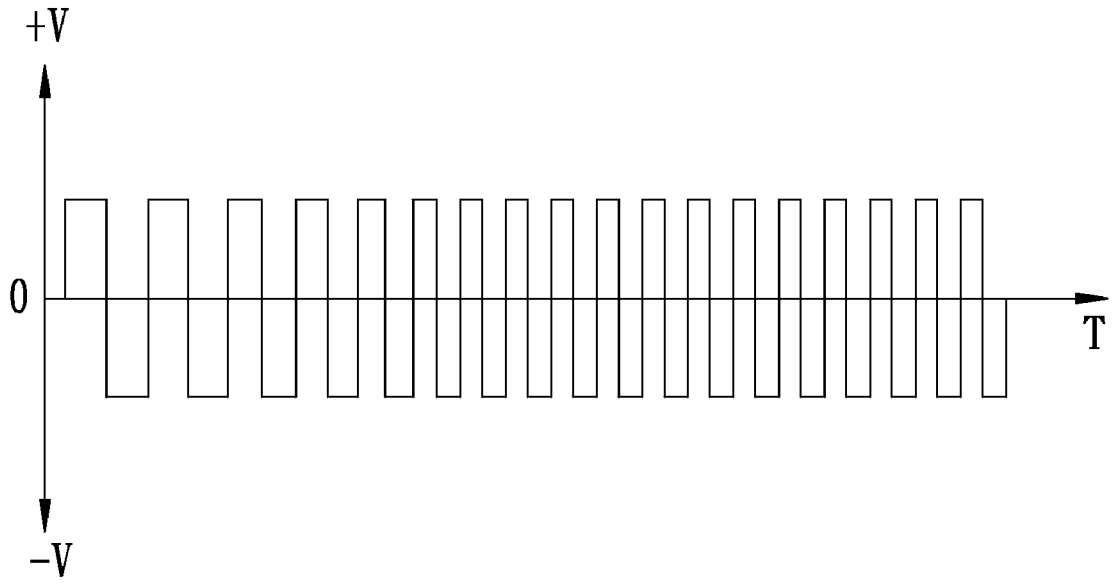
FIG. 10 is a sequence diagram, illustrating power supply of a low level through a high level at different frequencies.

Refer to FIGS. 6 and 10 respectively shown as a circuit block diagram and a control unit according to this invention, illustrating power supply of a low level through a high level at different frequencies. The excitation circuit 52 is connected to an input terminal 301 of the stator 30 to excite the stator unit 30, thereby the rotor 33 being driven to rotate. The signal controller 51 supplies power to the excitation circuit 52 and may continuously generates the pulse signals of different frequencies, and when the controller 51 supplies power, the pulse signals of increasing frequencies is supplied to the excitation circuit 52 to excite the stator unit 30, thereby the rotor 33 being driven to rotate increasingly fast at a rating speed.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A DC brushless motor pump, comprising:

a body provided with a housing and a cover sealing one side of the housing, a chamber being formed between the housing and the cover;

a cylinder provided extending outwards from the chamber of the housing that defines an opening;

a rotor surrounding the cylinder and comprising a rotating shaft and an annular magnetic member surrounding an outer circumference of the rotating shaft;

a stator unit mounted in the chamber and including a plurality of silicon steel laminations and a plurality of coils continuously surrounding the steel laminations comprising a basal portion, in which a pair of arms are provided extending upwardly from two sides of the basal portion that is formed with a free end at two sides of the cylinder, in which a pair of arc-shaped grooves are formed corresponding to the top ends of the arms and the cylinder is provided between the arc-shaped grooves;

a fan blade member axially provided at a front end of the rotating shaft, in which the rotor is inserted into the cylinder through the opening such that the fan blade member is positioned outside the opening;

a front cover sealing the opening of the cylinder, defining a hollow, and covering the fan blade member, the fan blade member thus being exactly arranged in the center of the hollow, and a water intake tube and a water outlet tube being provided around the outer circumference of the front cover; and a control unit comprising an excitation circuit connected to the stator unit, a signal controller connected to the excitation circuit, and a magnetic induction module connected to the signal controller, in which the excitation circuit may excite the stator unit and generate pulse signals of different frequencies to drive the rotor to run and further the magnetic induction module senses the N and S poles of the rotor and meanwhile generates a signal feedback to the signal controller.

2. The DC brushless motor pump according to claim 1, wherein the silicon steel laminations substantially has a U shape, of which two sides are formed with the arms, and the coils wrap around the arms of the silicon steel laminations.

3. The DC brushless motor pump according to claim 1, wherein an orientation component in the form of L upside down is provided, where a first plate is provided lengthways extending outwards from the middle of the outer circumferential wall of the cylinder, a second plate is provided transversally extending from the top end of the first plate, so a container portion is formed between the outer circumferential walls of the first plate, second plate, and the orientation component, thereby making the container portion slightly lean to a free end of one side of the stator unit and making the magnetic induction module to be exactly inserted into the container portion for clamping.

4. The DC brushless motor pump according to claim 1, wherein the magnetic induction module is a Hall element.

5. The DC brushless motor pump according to claim 1, wherein the chamber of housing is filled with a filling glue.

6. The DC brushless motor pump according to claim 5, wherein the filling glue is a foam resin.

* * * * *